US008704113B2

(12) United States Patent
Itoshiro et al.

(10) Patent No.: US 8,704,113 B2
(45) Date of Patent: Apr. 22, 2014

(54) KEYBOARD AND ELECTRONIC APPARATUS

(75) Inventors: Yasushi Itoshiro, Nagano (JP); Shigeru Kurosu, Nagano (JP); Hiroshi Katayama, Nagano (JP)

(73) Assignee: Sony Corporation, Tokyo (JP)

( * ) Notice: Subject to any disclaimer, the term of this patent is extended or adjusted under 35 U.S.C. 154(b) by 131 days.

(21) Appl. No.: 13/315,927

(22) Filed: Dec. 9, 2011

(65) Prior Publication Data

US 2012/0152717 A1 Jun. 21, 2012

(30) Foreign Application Priority Data

Dec. 17, 2010 (JP) ..... P2010-281450

(51) Int. Cl.
*H01H 1/10* (2006.01)

(52) U.S. Cl.
USPC ..... 200/5 A; 200/511; 200/341; 200/302.2

(58) Field of Classification Search
USPC ..... 200/5 A, 5 R, 511, 515, 517, 341, 306, 200/302.2
See application file for complete search history.

(56) References Cited

U.S. PATENT DOCUMENTS

| | | | | |
|---|---|---|---|---|
| 3,699,294 | A * | 10/1972 | Sudduth | 200/243 |
| 4,317,011 | A * | 2/1982 | Mazurk | 200/5 A |
| 4,520,248 | A * | 5/1985 | Woelfel | 200/514 |
| 5,152,392 | A * | 10/1992 | Iwasa | 200/517 |
| 7,186,938 | B2 * | 3/2007 | Ito | 200/512 |
| 2003/0029709 | A1 * | 2/2003 | Serizawa et al. | 200/512 |
| 2008/0285216 | A1 | 11/2008 | Kobayashi et al. | |
| 2009/0079593 | A1 | 3/2009 | Yamakawa et al. | |
| 2009/0279238 | A1 | 11/2009 | Kobayashi et al. | |

FOREIGN PATENT DOCUMENTS

| | | |
|---|---|---|
| JP | 2008-287422 | 11/2008 |
| JP | 2009-75980 | 4/2009 |
| JP | 2009-294809 | 12/2009 |

* cited by examiner

*Primary Examiner* — Kyung Lee
(74) *Attorney, Agent, or Firm* — Sony Corporation

(57) ABSTRACT

Disclosed herein is a keyboard, including: a membrane switch having contacts disposed at positions thereof corresponding to keys; a spacer member provided on the membrane switch and having openings at least at portions thereof corresponding to the keys; a resilient member provided on the spacer member and spaced from and opposed to the membrane switch through the openings; and a key member provided at a portion of the resilient member which corresponds to each of the keys.

20 Claims, 5 Drawing Sheets

KEYBOARD AND ELECTRONIC APPARATUS

BACKGROUND

The technique disclosed herein relates to a keyboard and an electronic apparatus, and more particularly to a keyboard and an electronic apparatus which includes the keyboard.

As a thin keyboard, a keyboard is widely used which uses a membrane switch. A membrane switch includes a plurality of sheets disposed such that two electrodes are disposed in a spaced relationship from and in an opposing relationship to each other. If a portion of the membrane switch at which such electrodes are disposed is depressed, then the two electrodes are placed into contact with each other to output a signal. In a keyboard which uses a membrane switch, such electrodes are disposed at positions corresponding to individual keys such that each of them outputs a signal when a corresponding key is depressed.

Such a keyboard as described above includes a key top guide mechanism for supporting the key tops so as not to be inclined in order to assure an inputting property and operability. In a thin keyboard, for example, a slide mechanism or a pantograph mechanism is used as the key top guide mechanism as disclosed, for example, in Japanese Patent Laid-Open No. 2009-75980 (hereinafter referred to as Patent Document 1), particularly in FIG. 8 and so forth.

SUMMARY

However, such a keyboard as described above has a problem that it, involves a large number of members and requires much time for assembly. For example, in the case of the keyboard which uses a pantograph mechanism as described in Patent Document 1, the number of members of key tops is equal to the number of keys, and the number of members of pantographs formed from two frames is twice the number of keys. Further, the number of members of cups which are resilient members interposed between the key tops and a membrane switch is equal to the number of keys. Consequently, the number of members only of such components is four times the number of keys.

Thus, it is desirable to provide a novel and improved keyboard which can be configured from a reduced number of members and a novel and improved electronic apparatus in which a keyboard can be configured from a reduced number of members.

According to an embodiment of the disclosed technology, there is provided a keyboard including a membrane switch having contacts disposed at positions thereof corresponding to keys, a spacer member provided on the membrane switch and having openings at least at portions thereof corresponding to the keys, a resilient member provided on the spacer member and spaced from and opposed to the membrane switch through the openings, and a key member provided at a portion of the resilient member which corresponds to each of the keys.

Where the keyboard has the configuration described above, it can be configured from a small number of members of simple shapes, and working of, the parts and assembly of the keyboard can be carried out readily.

The resilient member may be a flattened sheet-like member extending over a region corresponding to plural ones of the keys.

Or, the resilient member may be a single sheet-like member.

The spacer member may be a single plate-shaped member.

The spacer member may have a cut open portion for allowing air to leak from a space defined by the membrane switch, opening and resilient member.

The membrane switch may have a rough face at a portion thereof at which the membrane switch is contacted by the resilient member when the resilient member is depressed by the key member through the opening.

The keyboard may further include a cover member provided on the resilient member and the key member and having projections and recesses corresponding to the keys.

According to another embodiment of the disclosed technology, there is provided an electronic apparatus including a keyboard including a membrane switch having contacts disposed at positions thereof corresponding to keys, a spacer member provided on the membrane switch and having openings at least at portions thereof corresponding to the keys, a resilient member provided on the spacer member and spaced from and opposed to the membrane switch through the openings, and a key member provided at a portion of the resilient member which corresponds to each of the keys.

In summary, with the disclosed technology, a keyboard can be configured using a reduced number of members.

DETAILED DESCRIPTION OF THE PREFERRED EMBODIMENT

In the following, a preferred embodiment of the disclosed technology is described in detail with reference to the accompanying drawings.

It is to be noted that the description is given in the following order.

1. Related Art
2. Embodiment
3. Supplementary Explanation

1. Related Art

First, a related art necessary for description of an embodiment of the disclosed document is described. As described hereinabove, a keyboard which uses a membrane switch is used widely as a thin keyboard. In such a keyboard as just described, a mechanical key top guide mechanism such as a slide mechanism or a pantograph mechanism is provided. However, the number of members is great and much time is required for assembly. For example, in an example of a keyboard which uses a pantograph mechanism, in the case where the number of keys is 100, the number of members exceeds 400 which are four times of 100.

Further, in the case where such a mechanical key top guide mechanism as described above is used, there is a limitation to reduction in thickness of the keyboard. For example, in the case of a keyboard which uses such a pantograph mechanism as described above, the thickness from a back plate on which a membrane is provided to the key tops is 2.8 to 3.5 mm, and it is difficult, to further reduce the thickness. Further, upon keying, key top is contacted with a different part of the key top guide mechanism, and therefore, the keying sound is loud. Furthermore, since a plurality of separate members cover the surface of the membrane, the keyboard, is weak against invasion of liquid from above.

In contrast, as a thin keyboard which includes a small number of members, generates, quiet keying sound and besides is tough against invasion of liquid, an on-screen keyboard which uses a touch panel is available. However, since the touch panel is expensive, the cost of the on-screen keyboard is high. Further, since the touch panel reacts even with a light touch therewith, a key input is generated by such a touch that a hand is placed on the touch panel, resulting in high possibility of an incorrect operation. Further, since the surface of the touch panel is flat, identification of a key position relies upon visual observation, and it is difficult to use touch typing for an input.

2. Embodiment

Now, an embodiment of the disclosed technology is described. The present embodiment relates to a keyboard and an electronic apparatus such as a personal computer (PC) which includes the keyboard.

Figure 1:
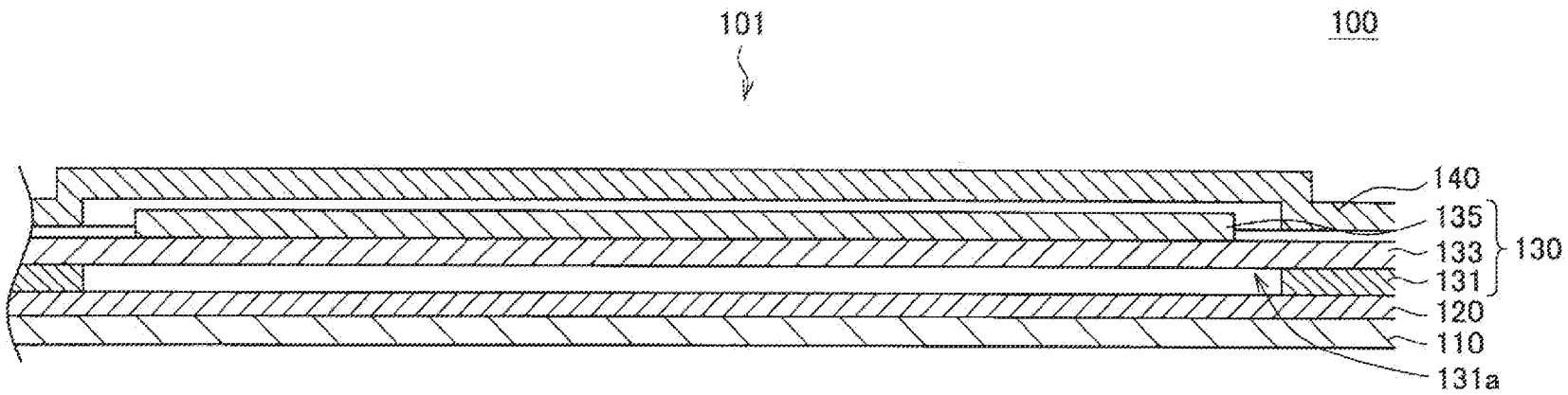
FIG. 1 is a schematic sectional view of a keyboard according to an embodiment of the disclosed technique.
Figure 2:
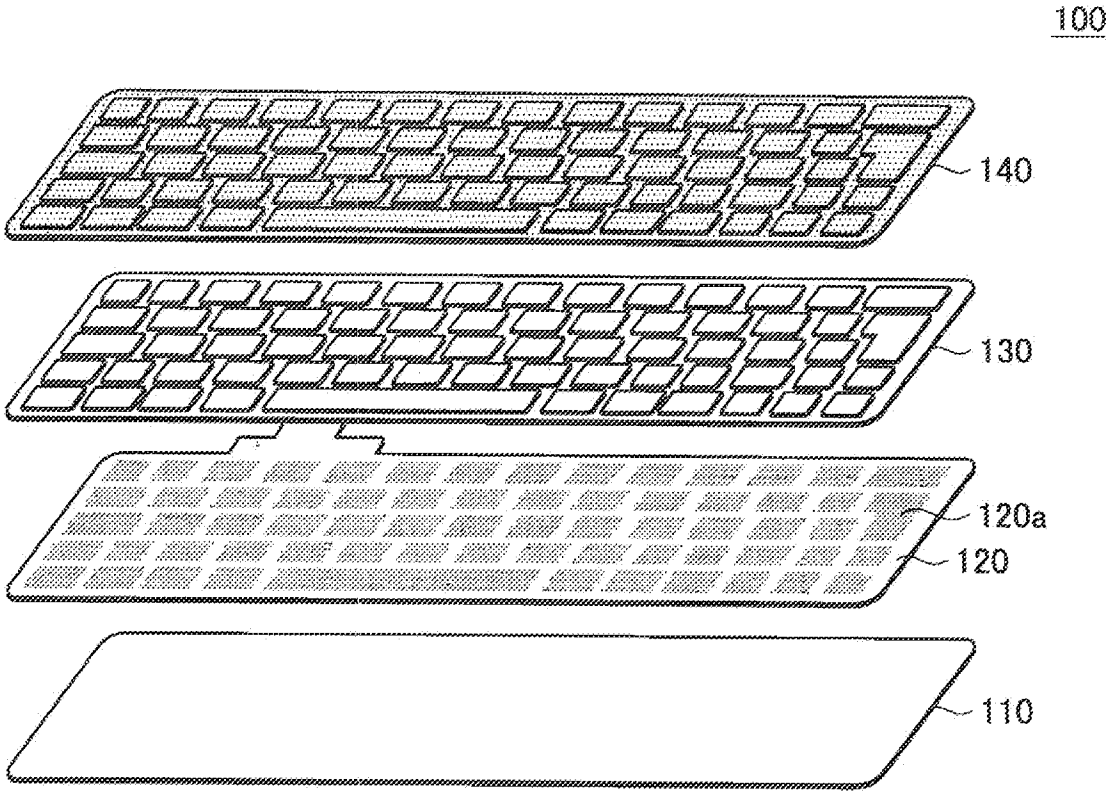
FIG. 2 is a schematic fragmentary perspective view showing a configuration of the keyboard of FIG. 1.
Figure 3:
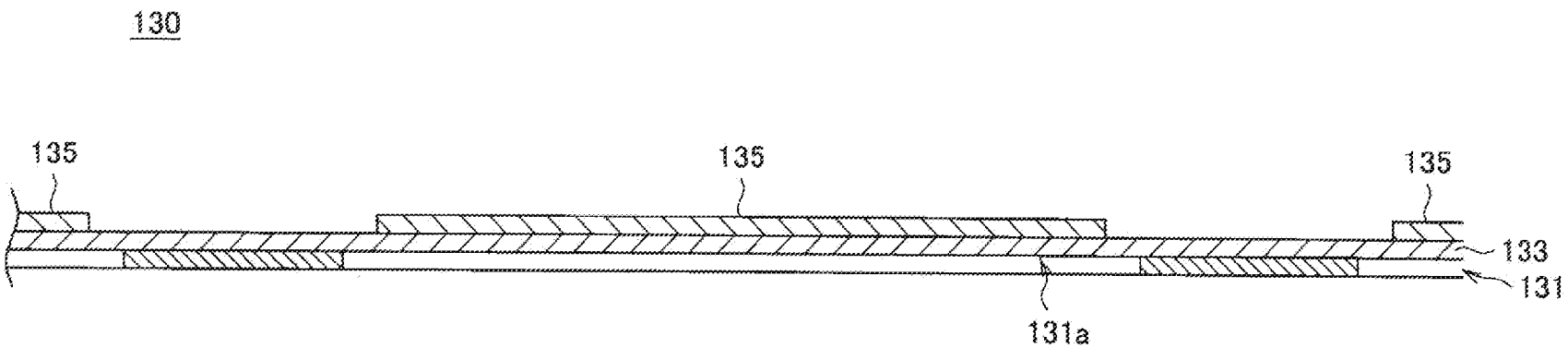
FIG. 3 is a schematic sectional view of a sheet assembly shown in FIG. 1.
Figure 4:
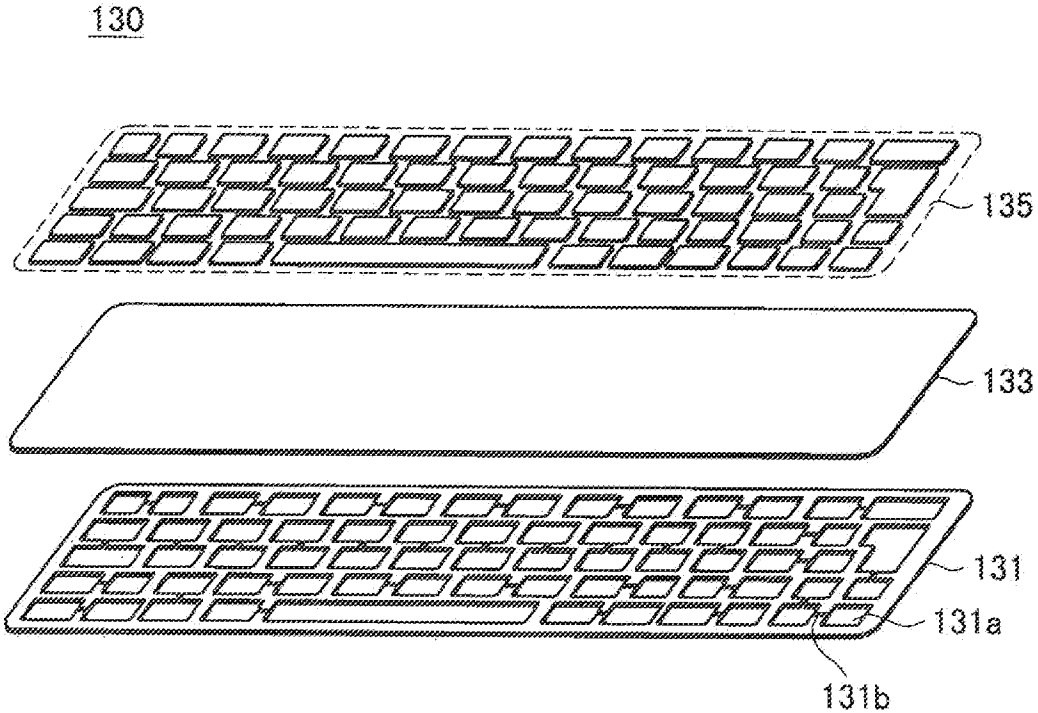
FIG. 4 is a schematic fragmentary perspective view of the sheet assembly of FIG. 3.

A configuration of the keyboard 100 according to the present embodiment is described below with reference to FIGS. 1 to 4. FIGS. 1 and 2 show a general configuration of the keyboard 100, and FIGS. 3 and 4 show a detailed configuration of a sheet assembly 130 included in the keyboard 100.

Referring to FIGS. 1 to 4, the keyboard 100 includes a back plate 110, a membrane switch 120, a sheet assembly 130, and a top rubber member 140. The sheet assembly 130 includes a spacer plate 131, a rubber sheet 133 and a key plate 135.

The back plate 110 is provided on the bottom of the keyboard 100. The back plate 110, may be a metal plate such as an aluminum plate in the form of a flat plate. The back plate 110 supports the other components including the membrane switch 120, sheet assembly 130 and top rubber member 140.

The membrane switch 120 is provided on the back plate 110. The membrane switch 120 includes two film-like members, and a plurality of contacts each including a pair of electrodes provided in a spaced relationship from and in an opposing relationship to each other on inner faces of the film-like members. The contacts of the membrane switch 120 are disposed at positions corresponding to keys 101 of the keyboard 100, and if the electrodes of any of the contacts are brought into contact with each other, then an electric signal corresponding to the key 101 is outputted. The membrane switch 120 is opposed at least at positions of the contacts thereof to the rubber sheet 133 through openings 131*a* of the spacer plate 131.

The membrane switch 120 may further have, at portions thereof opposed to the rubber sheet 133 through the openings 131*a* of the spacer plate 131, a rough face 120*a*. At this portion, the rubber sheet 133 depressed by the key plate 135 is brought into contact with the membrane switch 120 through the opening 131*a* upon keying of the keyboard 100. By providing the rough face 120*a*, the rubber sheet 133 contacting with or sticking to the membrane switch 120 can be removed smoothly by resilient force of the rubber sheet 133 itself.

The sheet assembly 130 is a member formed by adhering the spacer plate 131, rubber sheet 133 and key plate 135 to each other. Upon fabrication of the keyboard 100, after the sheet assembly 130 is assembled in advance, the back plate 110, membrane switch 120, sheet assembly 130 and top rubber member 140 may be laminated. By configuring the keyboard 100 in this manner, it is easy to exchange the sheet assembly 130 or the top rubber member 140 to change the appearance of the keyboard 100 or change the touch or the stroke upon keying.

The spacer plate 131 is a spacer member provided on the membrane switch 120. The spacer plate 131 may have a form of a flat plate and may be made of polyethylene terephthalate (PET) or polycarbonate. The spacer plate 131 has the openings 131*a* at least at portions thereof which correspond to the keys 101. The openings 131*a* may correspond one by one to the keys 101, or one opening 131*a* may correspond to a plurality of keys 101, for example, plural ones of the keys 101 arrayed in the leftward and rightward direction. In this instance, the opening 131*a* may have a shape of a groove extending in the leftward and rightward direction.

Each opening 131*a* of the spacer plate 131 assures a space between the membrane switch 120 and the rubber sheet 133 such that a stroke when the key 101 is depressed may be provided by the space. Since the stroke is generated, the user can feel the depression of the key upon keying. Further, since the stroke is generated, a key input is not generated by such a load as provided by a hand placed on the surface of the keyboard 100, resulting in reduction of the possibility of incorrect operation. It is to be noted that, by adjusting the thickness of the spacer plate 131, it is possible to adjust the magnitude of the stroke. For example, if the spacer plate 131 is formed thicker, then an increased stroke is obtained.

Further, the spacer plate 131 may be a single plate-like member. In this instance, one spacer plate 131 may be provided for one keyboard 100, and the number of members of the keyboard 100 can be reduced further. It is to be noted that, for the convenience of a fabrication procedure, the spacer plate 131 may be formed from a combination of a plurality of plate-like members.

Further, the spacer plate 131 may have cut open portions 131*b*. Each cut open portion 131*b* allows air to leak therethrough from a space defined by the membrane switch 120, an opening 131*a* and the rubber sheet 113. The cut open portion 131*b* can prevent the space from becoming an airtight space and prevent the air in the space from being compressed to make keying of the key 101 difficult. It is to be noted that, in the example illustrated in FIG. 4, each cut open portion 131*b* is provided between two openings 131*a* such that, when a key 101 corresponding to one of the openings 131*a* is operated, the cut open portion 131*b* allows the air from the one opening 131*a* to leak to the other opening 131*a*. The shape of the cut open portion 131*b* is not limited to this, but may be provided among three or more openings 131*a* or may be provided between an opening 131*a* and an end portion of the spacer plate 131 such that, when the key 101 corresponding to the opening 131*a* is operated, the air is allowed to leak to the outside through the cut open portion 131*b*.

The rubber sheet 133 is a resilient member provided on the spacer plate 131. The rubber sheet 133 may be formed from a material having resiliency such as silicon rubber. The rubber sheet 133 is opposed, at portions thereof corresponding to the openings 131*a* of the spacer plate 131, to the membrane switch 120 with a distance left therebetween.

Here, the rubber sheet 133 is pressed, upon keying of the keyboard 100, to move downwardly by the key plate 135 depressed through the top rubber member 140 by the user and is brought into contact with the membrane switch 120 through the openings 131*a*. At this time, the contact portion of the membrane switch 120 is sandwiched by the rubber sheet 133 and the back plate 110 to bring the electrodes thereof into contact with each other, whereupon an electric signal corresponding to the key is outputted. If the key plate 135 is released, then the rubber sheet 133 is spaced away from the membrane switch 120 by the resilient force thereof and returns to the original position assumed prior to the depression of the key plate 135.

Further, the rubber sheet 133 may be a flat sheet extending over a region corresponding to a plurality of keys 101. Since the spacer plate 131 is interposed between the rubber sheet 133 and the membrane switch 120, it is possible to form the rubber sheet 133 as a sheet of a simple shape which extends over a region corresponding to a plurality of keys 101. Although the keyboard which uses a mechanical key top guide mechanism presented hereinabove as the related art includes a cup-shaped resilient member for implementing a function similar to that of the rubber sheet 133, this resilient member is provided by one for each one key and has a complicated three-dimensional shape. In contrast, the rubber sheet 133 can by itself cover a plurality of keys 101 and is simple in shape. If the rubber sheet 133 which is a flat sheet-like member extending over a region corresponding to a plurality of keys 101 is used, then the number of members of the keyboard 100 can be reduced further and working of the members is facilitated.

Further, the rubber sheet 133 may be a single sheet-like member. In this instance, one rubber sheet 133 may be provided for one keyboard 100, and the number of members of the keyboard 100 can be reduced further. Further, if the rubber sheet 133 is formed as a sheet-like member having no opening, then since the membrane switch 120 is covered with the rubber sheet 133 formed as a unitary member having no gap, invasion of liquid from above the keyboard 100 can be prevented. It is to be noted that, also where the rubber sheet 133 is formed from a combination of a plurality of sheet-like members, invasion of liquid from above the keyboard 100 can be prevented partially.

The key plate 135 is a key member provided at a portion on the rubber sheet 133 corresponding to each key 101. The key plate 135 may have, for example, a shape of a flat plate and may be formed from PET or polycarbonate. Such key plates 135 may be provided in a one-by-one corresponding relationship to the key 101. Or, one key plate 135 may correspond to a plurality of keys 101, for example, four key 101 as cursor keys. Upon keying of the keyboard 100, one of the key plates 135 is depressed through the top rubber member 140 by the user to press the rubber sheet 133 into contact with the membrane switch 120.

Here, the material of the key plate 135 has an influence of a touch which the user feels upon keying of the keyboard 100. For example, in the case where the key plate 135 is made of a metal plate such as an aluminum plate, upon keying of the keyboard 100, a comparatively hard touch can be obtained.

Further, the shape of the key plate 135 may correspond to the shape of the opening 131*a* of the spacer plate 131. In this instance, upon keying of the keyboard 100, the key plate 135 is inserted into the opening 131*a* via the rubber sheet 133. Accordingly, the shape of the key plate 135 may be a little smaller than the shape of the opening 131*a*. In order to implement smooth keying, the difference in dimension between the key plate 135 and the opening 131*a* in this instance may be, for example, approximately 0.5 mm.

The top rubber member 140 is a cover member which is provided on the rubber sheet 133 and the key plate 135 and has projections and recesses corresponding to the keys 101. The top rubber member 140 may be formed from a material having resiliency such as silicon rubber. If the top rubber member 140 has projections and recesses corresponding to the keys 101, then the user can recognize the position of a key 101 by the sense of touch, and also inputting by touch typing is possible.

Further, the top rubber member 140 may be a decorative member which covers the rubber sheet 133 and the key plate 135. Accordingly, different from the back plate 110, membrane switch 120 and sheet assembly 130, the top rubber member 140 may not be joined closely to another member. Therefore, the top rubber member 140 may be a member which can be separated from another member and can be exchanged readily. In the case where the top rubber member 140 can be exchanged readily, for example, some design such as the color of the surface of the keyboard 100 or the font of characters indicating the keys 101 can be changed readily.

Since the members of the keyboard 100 described above are all thin members in the form of a sheet or a plate, in an, example of the keyboard 100, the thickness from the back plate 110 to the top rubber member 140 is approximately 1.94 mm, and significant reduction in thickness is implemented in comparison with the keyboard which uses a pantograph mechanism presented hereinabove as the related art.

Further, in the keyboard 100, the number of members other than the key plate 135 does, not rely upon the number of keys 101. For example, the spacer plate 131 and the rubber sheet 133 can individually be made a single member. In this instance, even if the key plates 135 are made correspond one by one to the keys 101, the number of members of the keyboard 100 is substantially equal to the number of key 101. In short, if the number of keys of the keyboard 100 is 100, then the number of members is substantially equal to the key number of 100 and is approximately ¼ the number of members of the keyboard which uses a pantograph mechanism presented hereinabove as the related art.

Further, in the keyboard 100, upon operation of a key 101, the rubber sheet 133 is pressed into contact with the membrane switch 120. Consequently, since the comparatively soft rubber sheet 133 contacts with the membrane switch 120, the keying sound is quiet and the fatigue or the pain to the hands of the user by keying for a long period of time can be reduced. Further, if the material of the rubber sheet 133 is changed to another material having different resiliency, the touch which the user feels upon keying of the keyboard 100 can be changed.

In addition, the members of the keyboard 100 can be made transparent members by using, for example, PET or silicon rubber. Therefore, the keyboard 100 can be formed as a backlight keyboard, for example, by installing a light source between the back plate 110 and the membrane switch 120.

Figure 5:
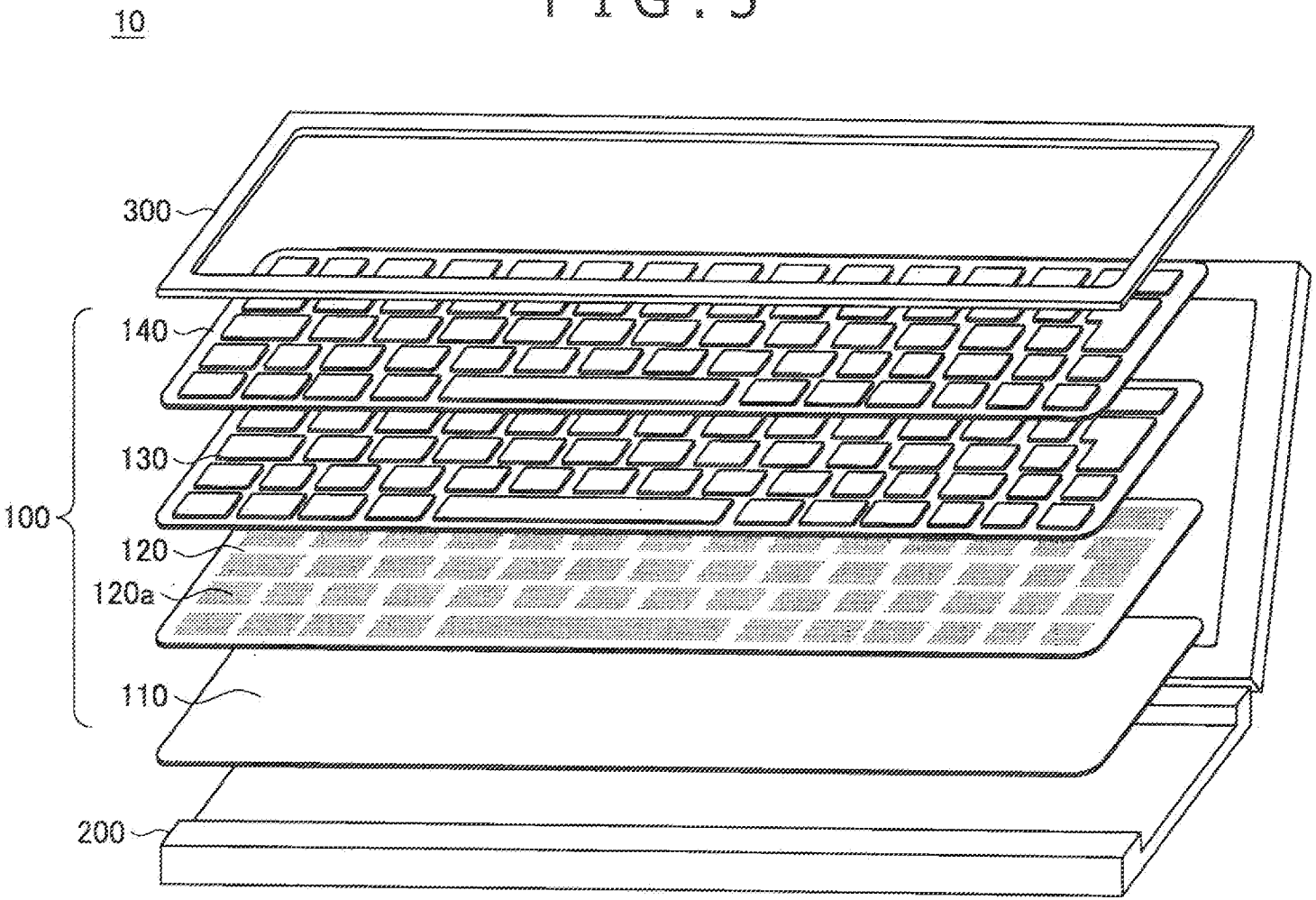
FIG. 5 is a schematic perspective view showing a configuration of an electronic apparatus according to the embodiment.

FIG. 5 schematically shows a configuration of an electronic apparatus 10 according to the present embodiment. Referring to FIG. 5, the electronic apparatus 10 includes a keyboard 100 which in turn includes a back plate 110, a membrane switch 120, a sheet assembly 130 and a top rubber member 140. The electronic apparatus 10 may be, for example, such a notebook type PC as shown in FIG. 5, a keyboard apparatus connected to a desk top type PC using a USB (Universal Serial Bus) or the like, or a mobile apparatus such as a portable telephone set.

The back plate 110, membrane switch 120, sheet assembly 130 and top rubber member 140 included in the keyboard 100 are adhered to each other using, for example, a double-sided adhesive tape, and the back plate 110 is adhered to a main body 200. Further, in order to fix the keyboard 100, a keyboard bezel 306 may be mounted. Further, the membrane switch 120 is electrically connected to internal wiring lines of the main body 200 in order to output an electric signal corresponding to an operated key 101.

It is to be noted that, in the keyboard 100, the keying sound upon operation of a key 101 is quiet. Although this is in most cases an advantage, depending upon the user, louder keying sound may be favorable in order to confirm whether or not keying is carried out. In such an instance, the main body 200 may output sound or vibration as feedback to keying in response to an electric signal outputted from the membrane switch 120 so that an agreeable operation feeling may be provided to the user.

3. Supplementary Explanation

The embodiment of the disclosed technology described can be modified in various manners. For example, while, in the embodiment described above, both of the back plate and the spacer plate are rigid members, the disclosed technology is not limited to this. For example, the back plate and the spacer plate may be flexible members. In this instance, the keyboard 100 can be rolled or folded. Also the key plate may be a flexible member.

The present application contains subject matter related to that disclosed in Japanese Priority Patent Application JP 2010-281450 filed in the Japan Patent Office on Dec. 17, 2010, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A keyboard, comprising:

a membrane switch having contacts disposed at positions corresponding to keys;

a spacer member provided on said membrane switch and having openings at least at portions thereof corresponding to said keys;

a first resilient member provided on said spacer member and spaced from and opposed to said membrane switch through said openings;

a key member provided at a portion of said first resilient member which corresponds to each of said keys; and a second resilient member provided on said key member and having a plurality of protections corresponding to said keys, wherein when said key member is depressed through said second resilient member, said first resilient member is brought into contact with said membrane switch through said openings.

2. The keyboard according to claim 1, wherein said first resilient member is a flattened sheet-like member extending over a region corresponding to plural ones of said keys.

3. The keyboard according to claim 1, wherein said first resilient member is a single sheet-like member.

4. The keyboard according to claim 1, wherein said spacer member is a single plate-shaped member.

5. The keyboard according to claim 1, wherein said spacer member has a cut open portion for allowing air to leak from a space defined by said membrane switch, said opening and said first resilient member.

6. The keyboard according to claim 1, wherein said membrane switch comprises a rough face at a portion thereof at which said membrane switch is contacted by said first resilient member when said first resilient member is depressed by said key member through said opening.

7. The keyboard according to claim 1, further comprising: a cover member provided on said first resilient member and said key member and having projections and recesses corresponding to said keys.

8. An electronic apparatus, comprising:

a keyboard comprising:

a membrane switch having contacts disposed at positions thereof corresponding to keys;

a spacer member provided on said membrane switch and having openings at least at portions thereof corresponding to said keys;

a first resilient member provided on said spacer member and spaced from and opposed to said membrane switch through said openings;

a key member provided at a portion of said first resilient member which corresponds to each of said keys; and a second resilient member provided on said key member and having a plurality of projections corresponding to said keys, wherein when said key member is depressed through said second resilient member, said first resilient member is brought into contact with said membrane switch through said openings.

9. The electronic apparatus according to claim 8, wherein said first resilient member is a flattened sheet-like member extending over a region corresponding to plural ones of said keys.

10. The electronic apparatus according to claim 8, wherein said first resilient member is a single sheet-like member.

11. The electronic apparatus according to claim 8, wherein said spacer member is a single plate-shaped member.

12. The electronic apparatus according to claim 8, wherein said spacer member has a cut open portion for allowing air to leak from a space defined by said membrane switch, said opening and said first resilient member.

13. The electronic apparatus according to claim 8, wherein said membrane switch has a rough face at a portion thereof at which said membrane switch is contacted by said first resilient member when said first resilient member is depressed by said key member through said opening.

14. The electronic apparatus according to claim 8, further comprising a cover member provided on said first resilient member and said key member and having projections and recesses corresponding to said keys.

15. The keyboard according to claim 1, further comprising a body configured to enclose said membrane switch, said spacer member, said resilient member, and said key member, wherein said body is configured to generate a feedback based on a signal from said membrane switch in response to a user operation, wherein said feedback comprises an audio output.

16. The keyboard according to claim 15, wherein said feedback comprises a tactile output.

17. An electronic apparatus, comprising:

a back plate;

a membrane switch provided on said back plate and having contacts disposed at positions corresponding to keys;

a spacer member provided on said membrane switch and having openings at least at portions thereof corresponding to said keys;

a first resilient member provided on said spacer member and spaced from and opposed to said membrane switch through said openings;

a key member provided at a portion of said first resilient member which corresponds to each of said keys; and a second resilient member provided on said key member and having a plurality of projections corresponding to said keys, wherein when said key member is depressed through said second resilient member, said first resilient member is brought into contact with said membrane switch through said openings.

18. The electronic apparatus according to claim 17, further comprising a light source between said back plate and said membrane switch.

19. The electronic apparatus according to claim 17, further comprising a body configured to enclose said membrane switch, said spacer member, said first resilient member, and said key member, wherein said body is configured to generate a tactile feedback indicative of an operation to a user.

20. The electronic apparatus according to claim 8, wherein said back plate and said membrane switch are adhered to each other using a double-sided adhesive tape, and wherein said back plate is adhered to a body.

* * * * *